US007179004B2

(12) United States Patent
Cetera

(10) Patent No.: US 7,179,004 B2
(45) Date of Patent: Feb. 20, 2007

(54) CLIP WITH SLIDABLE MEMBER

(75) Inventor: Carl Cetera, Tenafly, NJ (US)

(73) Assignee: Cotapaxi Custom Design and Manufacturing, LLC, Carlstadt, NJ (US)

( * ) Notice: Subject to any disclaimer, the term of this patent is extended or adjusted under 35 U.S.C. 154(b) by 63 days.

(21) Appl. No.: 10/764,029

(22) Filed: Jan. 22, 2004

(65) Prior Publication Data

US 2005/0163555 A1 Jul. 28, 2005

(51) Int. Cl.
*B43K 23/02* (2006.01)
*B43K 29/00* (2006.01)
*B43K 25/00* (2006.01)

(52) U.S. Cl. ..... 401/131; 401/195; 24/11 R; 24/11 HC

(58) Field of Classification Search ..... 401/131, 401/52, 195; 24/11 HC, 11 R, 11 FE, 11 F, 24/11 CC, 11 C, 3.12
See application file for complete search history.

(56) References Cited

U.S. PATENT DOCUMENTS 1,396,395 A * 11/1921 Beck ..... 15/429
2,039,410 A * 5/1936 Harris ..... 15/432
2,567,602 A * 9/1951 Higgins ..... 224/231
3,576,053 A 4/1971 Chiang
3,652,172 A 3/1972 Zepell
3,796,501 A 3/1974 Zepell
4,155,474 A * 5/1979 Bizzarri ..... 215/365
4,518,274 A 5/1985 Hanggi
4,981,382 A 1/1991 Murphy
6,045,281 A 4/2000 Bunn
6,308,380 B1 10/2001 Cheng
6,332,247 B1 * 12/2001 Hsieh ..... 24/11 R
6,640,350 B1 * 11/2003 Deutsch ..... 4/309
D494,217 S 8/2004 Tien
6,890,116 B1 * 5/2005 Petroskey et al. ..... 401/104

* cited by examiner

*Primary Examiner*—David J. Walczak
(74) *Attorney, Agent, or Firm*—The Soni Law Firm

(57) ABSTRACT

A clip comprising a slidable member upon at least one track with two parallel rails. The clip may be attached to a handheld instrument, such as a pen. Indicia, such as an advertising logo, or graphic material may be placed upon the slidable member, possibly with a transparent cover on it.

15 Claims, 1 Drawing Sheet

CLIP WITH SLIDABLE MEMBER

BACKGROUND OF THE INVENTION

1. Field of the Invention

The present invention relates to a clip for an elongated handheld instrument. More specifically, the present invention relates to a slidable member placed upon the clip of a handheld instrument, for example, a writing instrument. Moreover, the present invention comprises placing advertising upon a pen clip in order to get the attention of a consumer. The present invention also relates to a method for getting the attention of a consumer by placing advertising upon a handheld writing instrument. Additionally, the present invention relates to a method of relieving emotional stress by providing a writing instrument with which the user can fidget, while at the same time repeatedly exposing, or continuously maintaining, the advertising indicia in the user's attention.

2. Description of the Prior Art

Clips upon writing instruments have been common for almost a century. It is also well known that advertising can be put upon writing instruments to get the attention of consumers. The advertising has taken the form of printing upon a pen barrel or clip. Such advertising has the disadvantage of utilizing only the visual sense for attracting the attention of a person, for example the consumer. There has not been any significant appeal to the other senses, for example, the kinesthetic sensation of touch, to attract the attention of the consumer to the advertising.

It is also well known that many individuals have a nervous habit of clicking a pen or mechanical pencil mechanism in order to relieve emotional stress. Although this habit may provide some stress relief, it has the disadvantage of wearing upon the mechanism of the writing instrument itself.

SUMMARY OF THE INVENTION

It is accordingly an object of the present invention to provide a clip with advertising for use upon a handheld instrument, for example a writing instrument, said clip appealing not only to the visual senses, but also to the sensation of touch and movement. The clip and more particularly the advertising will get markedly more attention by the consumer than a stationary advertising imprint.

It is thus another object of this invention to provide a method of attracting and maintaining the attention of a consumer to advertising by means other than a stationary picture on a device.

Still another object of this invention is to provide a handheld writing instrument that has incorporated into it a mechanism with a movable member that can help relieve nervous stress without wearing upon the pen writing tip extension mechanism.

It is yet another object of the present invention to provide a method for the relief of nervous stress in a handheld instrument.

The objects of this invention are accomplished by an innovative type of clip that has a slidable member articulated into the clip. The slidable member can have indicia such as advertising or a logo placed upon it. The movement of the slidable member will be unusual to the typical consumer and will quickly attract the attention of the owner-consumer as well as their friends, co-workers, and any other passerby that sees the clip. Furthermore, by providing this slidable member upon the clip, a person, for example a consumer, will pay more attention to the advertising because they will tend to fidget, tinker, and play with the clip. This device appeals not only to the visual sense, but also the tactile sense of the consumer, thus attracting the attention of the consumer to the advertising or logo placed upon the slidable member. The consumer will be subconsciously exposed to the advertising by way of association with the tactile input even at times they are not looking at the advertising directly. This is an advantage over the prior known methods of advertising, by use of only stationary imprints and inserts, because the eye will be naturally drawn to the movement of the sliding clip member. Therefore, the movement of the slidable member will compel the consumer's eye's to focus upon the advertising.

Furthermore, this device allows a mechanism for the user to dissipate nervous stress without wearing away upon the pen mechanism itself. Many pens have been worn into exhaustion by the repeated clicking of the pen cartridge mechanism by an anxious or frustrated worker or student. The slidable member permits the user of the writing instrument to place wear upon the clip and not upon the cartridge mechanism. Another advantage of this slidable clip is that it is inexpensive to produce and attracts the attention of the consumer in a new way.

The handheld instrument of the present invention is comprised of an elongated body connected with a clip; said clip comprising an essentially rectangular shaped wire having two parallel rails and said clip having an upper end and a lower end; and said lower end connecting said rails; and a slidable member having an inner segment, an outer segment, and a middle segment; said middle segment being smaller in diameter than said inner segment and said outer segment; whereby said middle segment of said slidable member fits between the two parallel rails and may articulate with said rails such that said slidable member is movable upwardly and downwardly some distance between the upper and the lower end of said clip.

BRIEF DESCRIPTION OF THE DRAWINGS

The preferred embodiment of the present invention, representing the best mode contemplated, is illustrated in the accompanying drawings in which.

DETAILED DESCRIPTION

Figure 1:
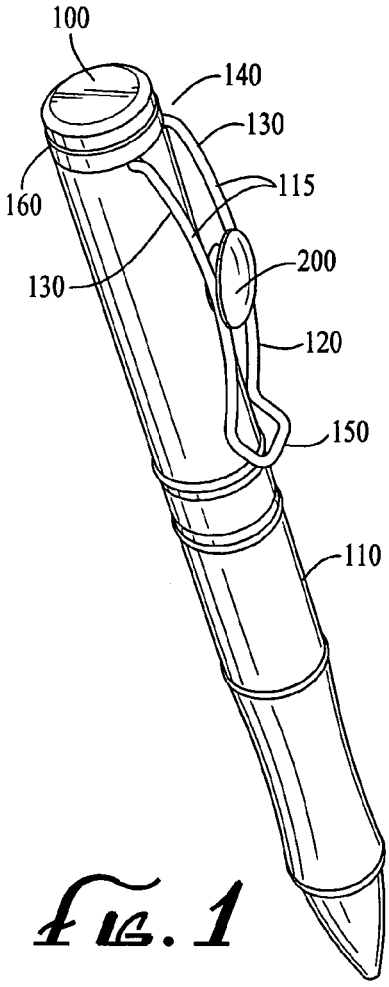
FIG. 1 is a perspective view of a handheld writing instrument in accordance with the present invention.

Referring now more specifically to the drawings, as shown in FIG. 1, the preferred embodiment of the present invention is a handheld writing instrument 100 comprising an elongated instrument body 110 and a clip 120. The handheld instrument 100 in the preferred embodiment is a pen or other suitable handheld writing instrument. However, such handheld instruments may also include, but are not limited to, for example, a laser pointer, PDA stylus, handheld pocket tool, or pocket knife. The clip 120 comprises at least one rail 130. A slidable member 200 is slidably connected with at least one rail 130 of said clip 120.

As may be seen in FIG. 1, in the preferred embodiment, the clip 120 comprises an essentially rectangular shaped track 115 having two parallel rails 130, and having an upper end 140 and a lower end 150. Said lower end 150 clip connects said parallel rails 130 together. The upper end 140 connects the clip 120 to the elongated instrument body 110.

In this preferred embodiment the essentially rectangular track is u-shaped, comprising two essentially parallel rails 130 with a space between. In this preferred embodiment, the rails 130 are formed from metal wire with suitable elasticity, rigidity, and diameter to prevent the two parallel rails 130 from being spread apart during routine movements of the slidable member 200.

Figure 2:
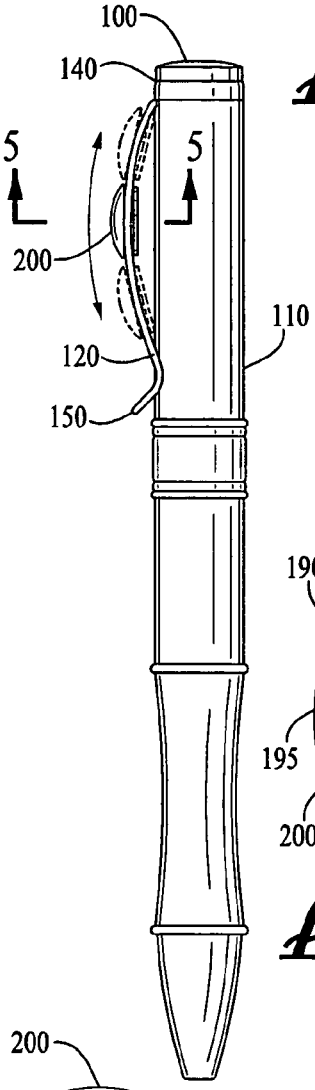
FIG. 2 is a side elevational view of a handheld writing instrument in accordance with the present invention.

Referring also now to FIG. 2, the slidable member 200 moves upwardly and downwardly between the upper end 140 and lower end 150 of the essentially rectangular track 115. The metal wire is bent into a U-shape, or rectangular shape, at the lower end 150, with the two free ends of the wire forming the upper end 140 of the clip 120 which is attached to the pen body 110 by a pen cap 160. The lower end 150 of the clip 120, however, is not limited to a U-shape or rectangular shape, and may also be various other geometric shapes.

In some embodiments, the rails 130 may be formed from plastic or other suitable materials. The rails may be plated, for example with chrome, to give the clip 120 a more expensive and pleasing appearance. The upper end 140 of the clip 120 is firmly attached to the pen by a pen cap 160 while the lower end 150 of the clip 120 forms a closed loop such that the slidable member 200 cannot slip off of the lower end 150 of the clip 120. In the preferred embodiment, there is a slight bend in the lower end 150 of the clip 120 away from the body 110 of the handheld instrument 100, in the range of 0 degrees to 45 degrees, allowing easier insertion into a shirt pocket or other anchoring location.

The anchoring of the upper end 140 of the clip 120 to the handheld instrument body 110 may be by a pen cap 160, or any one of many currently known means readily recognized by one skilled in the art. This may include, for example, a loop encircling the body 110 of the handheld instrument 100, insertion of the upper ends 140 of the clip 120 into holes in the pen body 110, or by bending of the upper end 140 of the clip 120 over the top of the handheld instrument 100 and securing the upper end 140 with a cap.

Figure 3:
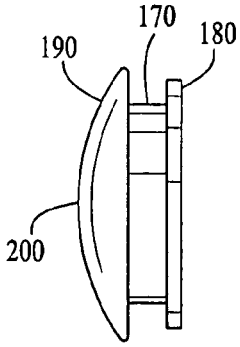
FIG. 3 is a side elevational view of the slidable member of the present invention.
Figure 4:
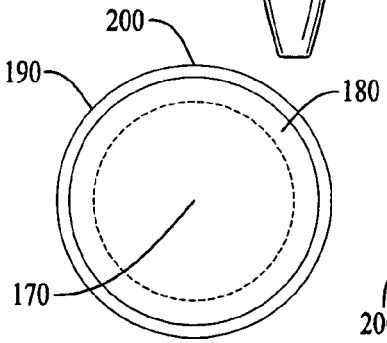
FIG. 4 is a bottom plan view of the slidable member of the present invention.

As can be seen in FIG. 3 and FIG. 4, in the preferred embodiment, the slidable member 200 comprises three segments. The inner segment 180 is most proximal to the elongated instrument body 110, and the outer segment 190 is the most distal from the elongated instrument body 110. The diameter of both the inner segment 180 and the outer segment 190 is greater than the distance between the two parallel rails 130. This retains the slidable member 200 upon the parallel rails 130. Between the inner segment 180 and the outer segment 190 is a narrower middle segment 170 that fits between the two parallel rails 130. These various slidable member segments may be separate pieces that are attached together during construction of the slidable member 200, or the three segments may be formed in one piece by, for example, by injection molding of the slidable member 200. The slidable member 200 of the clip may comprise, for example metal, plastic, wood, ceramic, or other suitable materials known to those in the art. In alternative embodiments, other ways of articulating a slidable member on one or more rails are equivalent. For example, a one piece slidable member with 2 parallel channels that accommodate the two parallel rails could be utilized, or a slidable member may be connected to a single rail.

Figure 5:
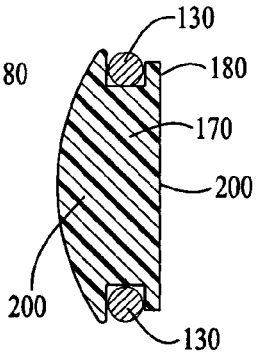
FIG. 5 is a vertical cross section through the slidable member of the present invention.

Referring now also to FIG. 5, in the preferred embodiment, the spacing between the parallel rails 130 is such that the middle segment 170 of the slidable member 200 fits between the parallel rails 130. This arrangement allows the middle segment 170 to sit securely between the two parallel rails 130 of the pen clip 120 and still permits the slidable member 200 to slide between the two parallel rails 130 from the upper end 140 of the clip 120 to the lower end 150 of the clip 120, without becoming dislodged. The rails are positioned so that there is sufficient clearance from the inner segment 180 of the slidable member 200 to the handheld instrument body 110 to permit free movement of the slidable member 200.

The user of the instrument 100 may fidget, play, squirm, wiggle, twitch, fuss, jitter, worry, tinker, putter, and fool with the slidable member 200, moving it easily up and down the rail(s) 130. This serves the function of allowing the user to dissipate emotion stress and nervous energy. One advantage of this arrangement is that users who have a nervous habit of clicking or twisting the pen mechanism of a regular type of pen may instead fidget with slidable member 200 upon the clip 120 of the present invention and thereby avoid wearing out the pen writing mechanism.

Other variations of slidably articulating a slidable member upon a pen clip will be readily recognized by those skilled in the art. For example, a variation of the slidable member 200 may be designed that articulates with a clip that is a substantially flat solid strip. For example, an embodiment of the slidable member 200 may be comprised of only the outer segment 190 which is then fitted with hooks that wrap around the outside of the substantially flat solid strip and slidably articulate the slidable member to the substantially flat solid strip. In yet another embodiment, for example, the slidable member may be designed to articulate with a clip that is a solid strip with a vertical narrow slot cut into the longitudinal center of the solid flat strip, and the middle segment 170 of the clip member is very narrow in diameter so that it may slide within the slot. In yet another embodiment, a slidable member could be one solid piece with channels drilled down either side to accept parallel wire rails. Yet other ways of slidably articulating a slidable member to a pen clip will be apparent to those skilled in the art.

Figure 6:
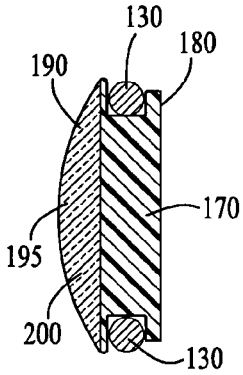
FIG. 6 is also a vertical cross section through the slidable member of the present invention.

In the preferred embodiment of the present invention, there is indicia visible on an outer surface of said outer segment 190 of the slidable member 200. This indicia for example may include but not be limited to a logo, trademark, advertisement, emblem, label, stamp, feature, brand, brand name, insignia, crest, token, seal, decal, pitch, announcement, slogan, monogram, or even a political message. Such indicia need not be limited to letters or words, but can also be a photo, design, or other pictorial representation. Furthermore, such indicia may be raised or textured to provide even more tactile sensory input to a person, for example, a consumer. This indicia may be printed on the outer surface of the outer segment 190 or alternatively, as shown in FIG. 6, may be imprinted upon the middle segment 170 and below a transparent outer covering 195, whereby the indicia is visible but less likely to wear off over time. Such indicia, coupled with the movement of the slidable member 200 markedly increases the attention of the consumer to advertising. Stationary advertising on pens is so common that consumers hardly pay attention to such advertising anymore. However, advertising on a slidable member will capture and hold the consumer's attention and is a valuable improvement in advertising methods. Furthermore, indicia will naturally attract the attention of the user as they fidget with the slidable member 200 and thus provide a valuable marketing tool for commercial purposes.

Still another advantage of the clip 120 is to give the pen or handheld instrument an attractive appearance. The slidable member 200 will be visible to others when the handheld instrument 100 is clipped onto, for example, a shirt pocket, exposing the message on the slidable member 200 to others. A passerby will naturally be curious about the slidable member 200. Thus the advertising not only captures the attention of the pen owner, but also others that are drawn to the pen in a shirt pocket, for example. This can provide even more advertising and marketing of products associated with the indicia on the slidable member 200. Such advertising method is especially useful in marketing to teenagers who will be drawn to the unusual sliding mechanism of the present invention.

In another embodiment, the slidable member 200 is designed so that it cannot be voluntarily removed from between the rails 130 without destroying the clip 120. This prevents the user from removing the advertising indicia. However, in yet still other embodiments, the slidable member 200 may be made so that it can be voluntarily removed from or placed between the rails 130. This may be accomplished by the inner segment 180 or outer segment 190 of the slidable member 200 being detachable from the middle segment 170. Methods for doing this, for example by means of a snap, screw, or twisting mechanism, would be recognized by those skilled in the art. The slidable member 200 can then be freely exchanged for one with a different indicia or picture on the outer surface of the outer segment 190. Thus the user could easily change the slidable member 200 to display different messages depending on the user's mood and wishes. Furthermore, more than one slidable member 200 could be attached on one pen. For example, two or more slidable members, each with pictures of the user's children or various products and services to be advertised, may be applied to the clip 120. The interchangeability of the slidable members 200 allows marketing departments and sales representatives to quickly modify the advertising on the pens without having to wait for the production of the entire writing instrument. Only new slidable members 200 would need to be distributed to the sales force. This reduces shipping costs in addition to the time necessary for advertising of newly developed products.

Another aspect of the present invention is the novel method of getting the attention of a person, for example, a consumer for advertising purposes. The first step is constructing a slidable member 200 with indicia such as, for example, advertising or a logo upon the outer surface of said slidable member 200. The second step is constructing a clip 120 comprising the slidable member 200 between two parallel rails 130. The third step is placing said clip 120 upon a suitable handheld instrument body 110, for example a pen. The fourth step is providing said handheld instrument 100 with said clip 120 to a person, for example, a consumer, whereby the indicia is repeated brought to the attention of said consumer while the consumer is fidgeting with said slidable member 200.

Still another aspect of the present invention is the novel method of relieving the nervous stress of a user. The first step is constructing a slidable member 200. The second step is constructing a clip 120 comprising the slidable member 200 between two parallel rails 130. The third step is placing said clip 120 upon a suitable handheld instrument body 110, for example a pen. The fourth step is providing said handheld instrument 100 with said clip 120 to a user. The fifth step is said user playing and fidgeting with the slidable member 200 when the user is feeling anxious.

The present invention may be embodied in other specific forms without departing from the essential spirit or attributes thereof. It is desired that the embodiments described herein be considered in all respects as illustrative, not restrictive, and that reference be made to the appended claims for determining the scope of the invention.

What is claimed is:

1. A handheld instrument comprising:

a) an elongated instrument body;

b) a clip having an upper clip end and a lower clip end, said clip comprising at least one pair of parallel rails, the lower clip end connecting said at least one pair of rails together, the upper clip end being connected with said elongated instrument body; and c) a slidable member, slidingly articulated upon said at least one pair of parallel rails, said slidable member comprising a bottom segment, a middle segment, and a top segment wherein said middle segment is smaller in diameter than the other two segments to fit between said at least one pair of rails such that said slidable member is movable upwardly and downwardly between the upper and the lower clip ends.

2. A handheld instrument as in claim 1, wherein said slidable member further comprises advertising indicia imprinted upon said middle segment and below said top segment, and said top segment is fabricated from transparent material such that said indicia is visible.

3. A handheld instrument as in claim 1, wherein said slidable member further comprises advertising indicia imprinted upon an outer surface of said top segment such that said indicia is visible.

4. A handheld instrument as in claim 3, wherein said indicia is imprinted with three dimensional textures, whereby further sensory input is provided to the user of the handheld instrument.

5. A handheld instrument as in claim 1, wherein said handheld instrument is a writing instrument.

6. A handheld instrument as in claim 1, wherein said at least one pair of rails are formed as metal wires.

7. A handheld instrument as in claim 6, wherein said at least one pair of rails are bent away from said instrument body adjacent the lower clip end, thereby defining a clipping rail portion which is biased against said instrument body for clipping an article therebetween.

8. A handheld instrument as in claim 1, wherein said elongated instrument body defines thereon connecting holes which receive said at least one pair of rails at the upper clip end.

9. A handheld instrument as in claim 1, wherein said slidable member is detachable from, and reconnectible with, said at least one pair of rails.

10. A handheld instrument as in claim 1, wherein said slidable member defines channels configured to receive said at least one pair of rails therethrough.

11. A clip for a handheld instrument, said clip having an upper clip end and a lower clip end, said clip comprising:

a) at least one pair of parallel rails formed as metal wires and connected at the lower clip end; and b) a slidable member connected with said at least one pair of parallel rails and configured such that said member is movable upwardly and downwardly between the upper and the lower clip ends, said slidable member comprising a bottom segment, a middle segment, and a top segment, wherein said middle segment is smaller in diameter than the other two segments to fit between said at least one pair of rails.

12. A clip as in claim 11, wherein said slidable member further comprises advertising indicia imprinted upon said middle segment and below said top segment, and said top segment is fabricated from transparent material such that said indicia is visible.

13. A clip as in claim 11, wherein said slidable member further comprises advertising indicia imprinted upon an outer surface of said top segment such that said indicia is visible.

14. A clip as in claim 13, wherein said indicia is imprinted with three dimensional textures, whereby further sensory input is provided to the user of the handheld instrument.

15. A handheld instrument comprising:

a) an elongated instrument body defining clip-connecting holes thereon;

b) a clip having an upper clip end and a lower clip end, said clip comprising at least one pair of parallel rails formed as metal wires, said at least one pair of rails being engaged into said clip-connecting holes at the upper clip end and connected together at the lower clip end, said at least one pair of rails being bent away from said instrument body adjacent the lower clip end to define a clipping rail portion which is biased against said instrument body for clipping an article therebetween; and c) a slidable member connected with said at least one pair of parallel rails and configured such that said member is movable upwardly and downwardly between the upper and the lower clip ends.

* * * * *